United States Patent [19]

Petersen et al.

[11] 4,064,898

[45] Dec. 27, 1977

[54] PURGE AND CHARGE EQUIPMENT

[75] Inventors: Virgil F. Petersen, Cincinnati, Ohio; Willard L. Skirvin, Rochester, Mich.

[73] Assignee: Cincinnati Electronics Corporation, Cincinnati, Ohio

[21] Appl. No.: 670,022

[22] Filed: Mar. 24, 1976

[51] Int. Cl.[2] ..... B08B 5/00

[52] U.S. Cl. ..... 137/240; 137/624.14; 137/624.2

[58] Field of Search ..... 137/624.14, 15, 240, 137/624.18, 624.2; 235/201 ME; 62/77, 85, 292, 303, 475; 141/66

[56] References Cited

U.S. PATENT DOCUMENTS 3,942,518 3/1976 Tenteris ..... 137/624.14 X

*Primary Examiner*—Alan Cohan

*Attorney, Agent, or Firm*—Lowe, King, Price & Markva

[57] ABSTRACT

A completely self-contained portable apparatus that is easily carried scrubs contamination from a sealed container and charges the scrubbed container with inert gas. A housing for the apparatus carries a reservoir for the gas, a service line for supplying gas from the reservoir to the container, valves, and pneumatic logic for controlling the valves. One of the valves selectively supplies gas from the reservoir to the line or vents the line in response to a pneumatic signal derived by the logic means which is powered by gas in the reservoir. The logic means sequentially derives a preselected number of the pneumatic signals so that contamination in the container is scrubbed by the sequential flow of the gas into and out of the container through the line. The logic means also includes means for deriving a further pneumatic signal that activates a second valve to apply charging gas at a predetermined pressure from the reservoir to the line and the container so that the container is filled with the charging gas after having been scrubbed.

18 Claims, 8 Drawing Figures

PURGE AND CHARGE EQUIPMENT

FIELD OF THE INVENTION

The present invention relates generally to apparatus for scrubbing contamination from a container and for charging the scrubbed container with an inert gas, and more particularly, to scrubbing and charging apparatus wherein valve means for controlling the scrubbing and flow of charging gas is controlled by pneumatic logic means powered by the gas. The invention is described particularly in connection with scrubbing and charging an aircraft cryogenic converter; however, it is to be understood that the principles of the invention are applicable to scrubbing and charging any type of sealed container.

BACKGROUND OF THE INVENTION

Many modern aircraft include a cryogenic converter for supplying and regulating the flow of refrigerant to cool electronic equipment. The cryogenic converter includes a cryogenic refrigerator with a closed loop nitrogen system. It is necessary to periodically purge or scrub the cryogenic converters and recharge them with nitrogen to enable the refrigerator to function effectively. Scrubbing removes moisture and other contaminants having a tendency to enter the closed loop nitrogen system during operation of the electronic equipment.

The most commonly utilized procedure for scrubbing and charging a cryogenic converter requires 87 manual valve operations. Many of these operations are involved in 20 sequential applications of inert gas to the converter; each gas application is followed by an exhaust cycle when the gas is evacuated from the container. The sequential flow of the inert gas into and out of the converter scrubs the converter of contaminating liquid and other materials. After the container has been scrubbed, it is charged by the inert gas to a predetermined pressure which is dependent upon ambient temperature. The complex series of manual operations must be performed on top of a vertical stabilizer during widely diverse weather conditions which contribute to human errors and often result in unsatisfactory servicing of the converter.

In an attempt to automate the manual operations, an extremely expensive device employing electronic logic networks has been developed. This unit is not self-contained, nor is it portable, as it requires a 160 lb. nitrogen cylinder. Since electronic logic is employed, expensive external power cables must be used to drive the electronic networks, as well as solenoid valve actuators. The prior art unit includes power converting devices, complex electrical timing networks, and requires complex calibration test equipment.

It is, accordingly, an object of the present invention to provide a new and improved automatic apparatus for scrubbing a sealed container with an inert gas and for subsequentially charging the scrubbed container with the inert gas.

Another object of the invention is to provide a new and improved, completely self-contained, portable and easily carried apparatus for automatically scrubbing and charging a sealed container.

Another object of the invention is to provide a relatively inexpensive, self-contained and easily carried apparatus for automatically scrubbing contamination and charging each of a plurality of containers in sequence with an inert gas without using any electrical power.

BRIEF DESCRIPTION OF THE INVENTION

In accordance with the present invention, a valve means coupled between a source of inert gas and a sealed container to be scrubbed and charged, e.g., a cyrogenic converter, selectively (a) applies gas from the source to the container and (b) exhausts the container in response to a pneumatic signal derived from a pneumatic logic means powered by the gas source. The logic means sequentially derives a preselected number of pneumatic signals, whereby contamination in the container is scrubbed by the sequential flow of the gas into and out of the container. The logic means includes means for deriving a further pneumatic signal for activating the valve means to apply charging gas at a predetermined pressure from the source to the container after it has been scrubbed. The predetermined pressure is set as a function of ambient temperature and generally differs from the pressure supplied to the container during the scrubbing operation.

The apparatus is preferably self-contained and portable, being easily carried by an attendant and including a housing having a handle thereon. The housing includes a reservoir for the gas source, as well as the valve means and pneumatic logic. The housing also carries a service line that feeds scrubbing gas from the source to the container, vents the container, and charges the container via a connection to the valve means.

The logic means includes a pneumatic bi-stable flow controller, i.e., a flip-flop valve, having first and second stable states. The flip-flop valve includes an input port responsive to fluid from the reservoir, output port means and control port means. In response to pneumatic signals applied to the control port means, flow from the input port is selectively coupled to the output port means. A pneumatic means coupled to the output port means of the flip-flop valve derives pneumatic control pulses subsequent to changes in the state of the flip-flop. The pneumatic control pulses are coupled in a feedback arrangement to the control port means of the flip-flop valve to control the state thereof. The pneumatic control pulses are also coupled to the valve means as the pneumatic signal which controls the sequential flow of the gas into and out of the container for scrubbing.

Upon the derivation of a preselected number of the pneumatic signals, the pneumatic logic means is deactivated by preventing flow from the reservoir to it. The flow preventing means includes a pneumatic predetermined counter which effectively counts the number of times the flip-flop valve changes state.

To control the pressure of the fluid supplied to the container during the charging cycle, there is provided a variable pressure regulator which is preset as a function of ambient temperature. The variable pressure regulator is selectively connected and disconnected in the pneumatic circuit with the reservoir and the line while the container connected to the line is being charged and scrubbed by pneumatically activating a by-pass valve for the regulator in response to a pneumatic signal derived from the logic networks when the scrubbing sequence has been completed. Thereby, different pressures are applied to the line by the fluid in the reservoir while fluid is flowing into the container during the charging and scrubbing intervals.

It is, accordingly, a further object of the invention to provide a new and improved apparatus for scrubbing and charging a container with inert gas wherein the charging gas is the exclusive source of power for a pneumatic control circuit for valves connected between a source of the gas and the container being filled.

The above and still further objects, features and advantages of the present invention will become apparent upon consideration of the following detailed description of one specific embodiment thereof, especially when taken in conjunction with the accompanying drawing.

DETAILED DESCRIPTION OF THE DRAWINGS

Figure 1:
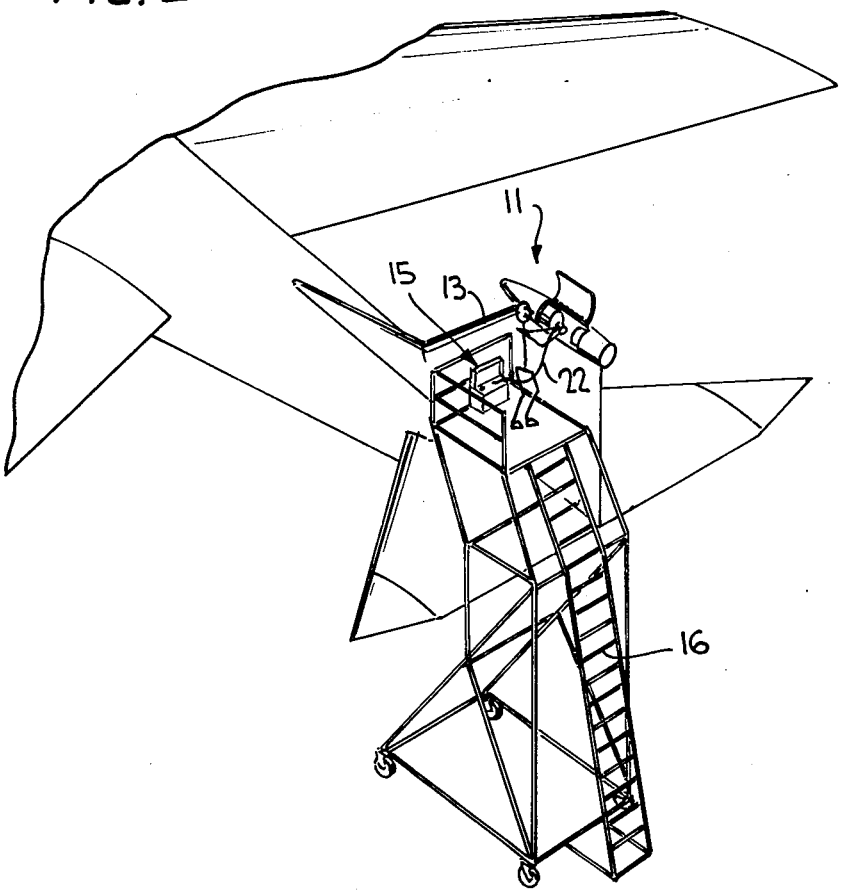
FIGS. 1 and 2 are illustrations indicating an environment in which the present invention may be used and the portable nature of the apparatus.
Figure 2:
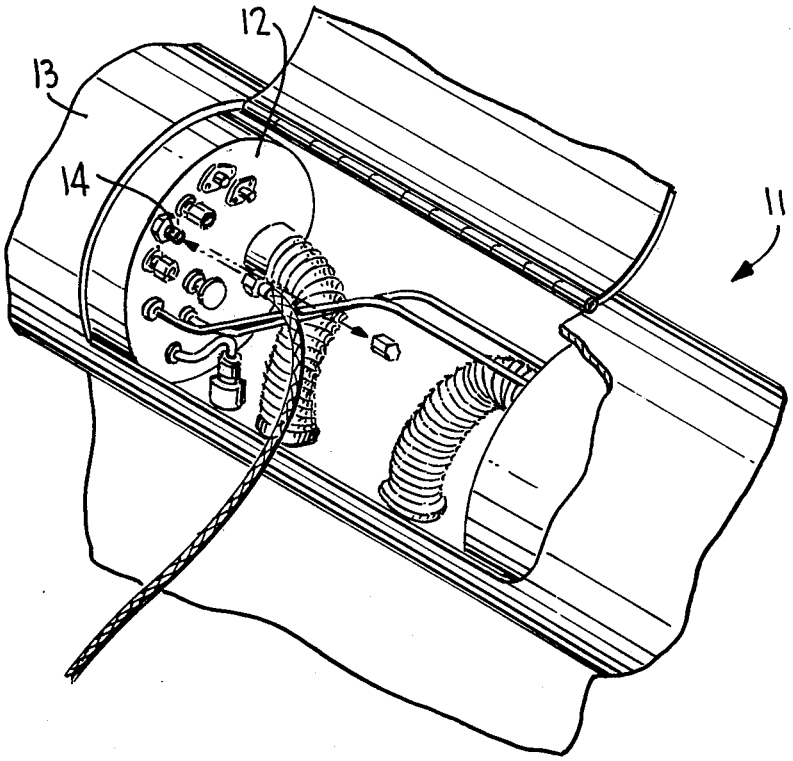
Figure 3:
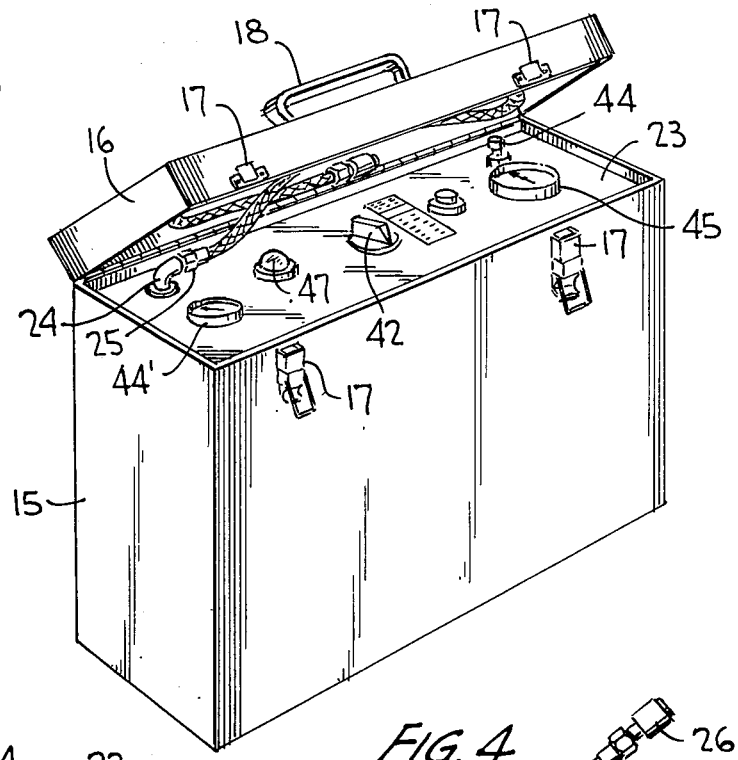
FIG. 3 is a perspective drawing of the housing for the apparatus of the invention.
Figure 4:
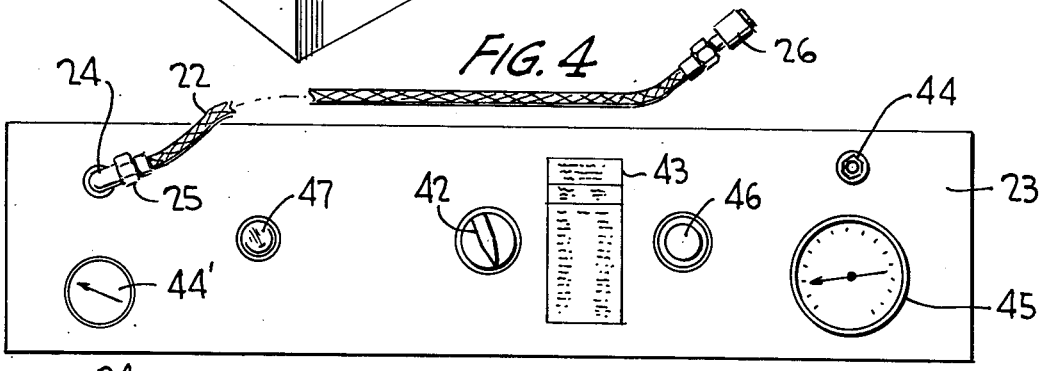
FIG. 4 is a front view of a panel included in the apparatus.
Figure 5:
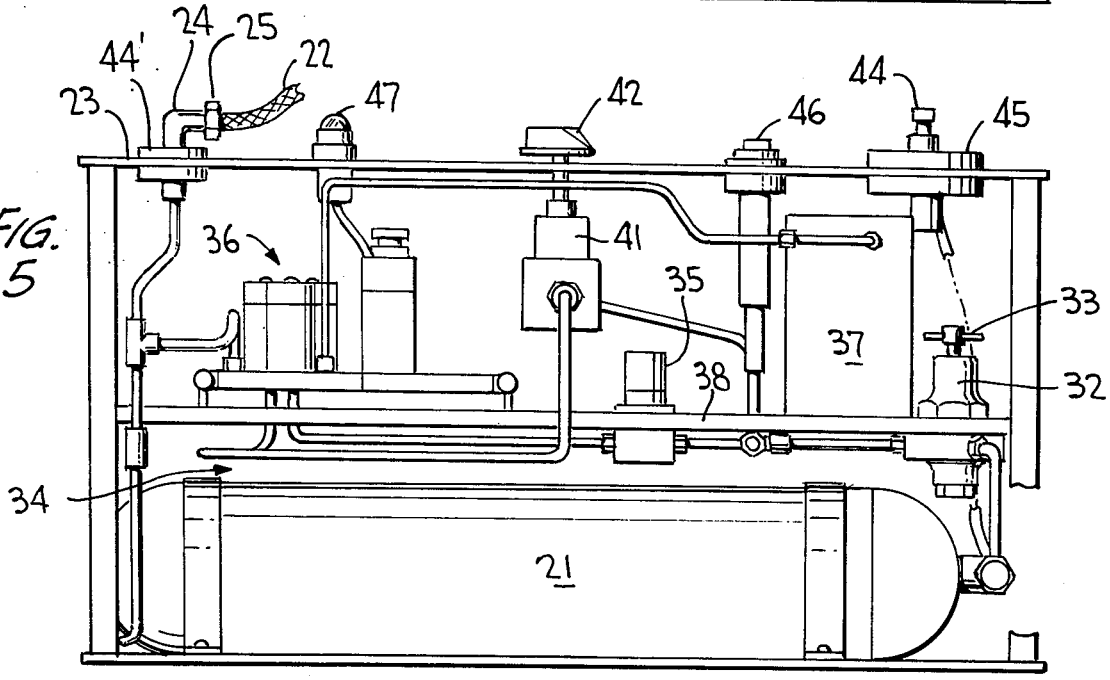
FIGS. 5 and 6 are respectively front and rear views of the apparatus.
Figure 6:
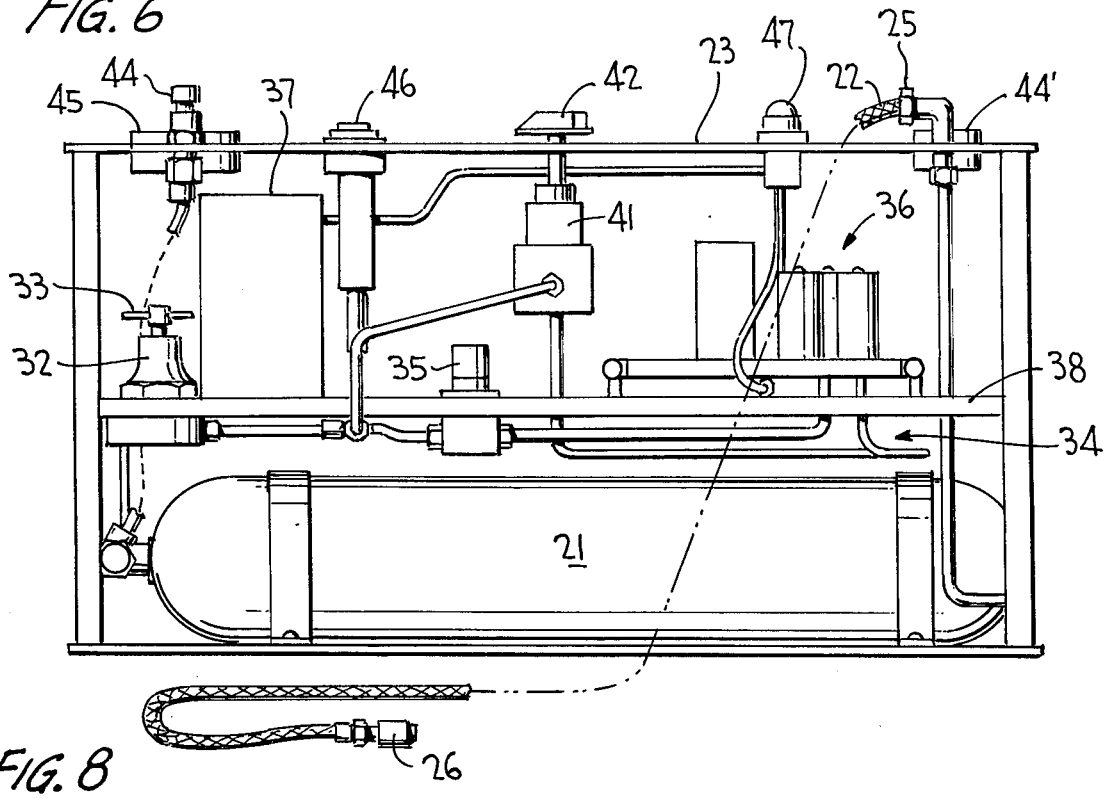

Reference is now made to FIGS. 1 and 2 of the drawing wherein there is illustrated an aircraft 11 including a cryogenic converter 12 mounted on the top of vertical stabilizer 13 of the aircraft. Cryogenic converter 12 is scrubbed to remove contamination and charged with inert nitrogen gas through fitting 14. Nitrogen gas is supplied to fitting 14 from portable, easily carried housing 15 containing completely self-contained apparatus for scrubbing contamination from the converter and for charging the scrubbed container with inert nitrogen gas. As illustrated in FIG. 3, housing 15 has a generally parallelepiped shape with a hinged top cover 16 that is secured in the closed position by latches 17 and which includes handle 18. Housing 15 is easily carried, since it weighs only about 40 lbs. and has dimensions of 6 × 16 × 23. The entire apparatus is easily brought into close proximity with converter 12 by an attendant grasping handle 18 and carrying the housing 15 up a portable stairway 16 to the top of stabilizer 13.

Housing 15 carries a stainless steel reservoir or bottle 21 containing the dry, inert nitrogen gas, maintained at a relatively high initial pressure on the order of 2,400 psig. Reservoir 21 has a capacity of 3 liters, sufficient for scrubbing, i.e., purging, and charging the cryogenic converters of 12 different aircrafts in sequence. Nitrogen gas is supplied to converter 12 from reservoir 21 through valving means contained in housing 15 and service line 22 that is connected to the valving means. Service line 22 is carried by front panel 23 of housing 15, with one end of the service line being connected to fitting 24 that is fixedly mounted on the panel. The end of service line 22 connected to fitting 24 includes a 5micron filter 25 to prevent any contaminants from flowing between reservoir 21 and the converter which is being scrubbed and charged. The end of service line 22 is selectively connected to fitting 14 by quick disconnect 26 which is carried by the line. Quick disconnect 26 includes a pair of oppositely biased check valves to prevent moisture from migrating through the quick disconnect and to maintain dry gas at the point of interconnection between service line 22 and the converter being purged and charged.

Dry fluid is supplied by reservoir 21 to service line 22 through high pressure relief valve 31, connected immediately downstream from the outlet of the reservoir. Relief valve 31 is a check valve biased to open at approximately 3,000 psig to prevent bursting of the reservoir 21. Valve 31 is connected to the inlet of high pressure regulator 32, which reduces the pressure of gas from the reservoir to a control pressure of 60 psig, as determined by the position of knob 33 on the regulator. Gas flowing from high pressure regulator 32 flows to central manifold 34 and thence in parallel to intermediate pressure regulator 35 and a pneumatic logic circuit 36 that is mounted on manifold 34. Pneumatic logic circuit 36 includes a pair of pneumatic timers and a 4-way flip-flop spool valve which functions as a bi-stable flow controller. The operation of the flip-flop and timers is discussed in detail infra. Predetermined pneumatic counter 37 counts the number of times the flip-flop valve changes states; in response to the number of state changes reaching a predetermined number, the counter derives a pneumatic output pulse to switch the apparatus from a purging mode to a charging mode. Regulators 32 and 35, as well as manifold 34 and counter 37, are fixedly mounted on panel 38 that extends between the sides of housing 15, in a direction parallel to panel 23.

Pneumatic logic elements 36 derive pneumatic control signals which are supplied to pressure selector and purge control valves that are also mounted on central manifold 34 and are connected in series between reservoir 21 and service line 22. When the apparatus is in a purge, i.e., scrubbing, mode, the pressure selector valve selectively feeds the 15 psig output of intermediate regulator 35 through the purge control valve to fitting 24, filter 25, service line 22 and converter 12. When the apparatus is in a charge mode, the pressure selector valve is responsive to a preselected pressure of the nitrogen gas, as coupled through variable, low pressure regulator 41, mounted on front panel 23. Low pressure regulator 41 includes a control knob 42 to enable the pressure of the charging nitrogen gas to be selected as a function of ambient temperature, typically in the range between 2.8 and 8.0 psig (for purposes of convenience the output of regulator 41 is assumed to be 6 psig). To this end, a pressure-temperature table 43 is provided on the front face of panel 23 to enable the attendant to select the correct charging pressure. The charging pressure is ascertained by reading the pressure indicated by gauge 44', fixedly mounted on the front face of panel 23 and connected in a line between the pressure selector and purge control valves. During the scrubbing mode, low pressure regulator 41 is bypassed by pneumatically activating the pressure selector valve with the pneumatic logic, as described infra.

Front panel 23 also carries fill port 44, reservoir pressure gauge 45, spring biased latched start switch 46 and pneumatically activated power indicator 47. Fill port 44 is connected directly to reservoir 21, in the same line as pressure gauge 45. Start switch 46 is manually activated to energize a valve so that 60 psig control pressure derived from regulator 32 is coupled to the logic means as long as converter 12 is being scrubbed. Upon the completion of the scrubbing operation, counter 37 derives a pulse to reset start switch 46 so that the pneumatic logic is unresponsive to fluid pressure. The flow of fluid through start switch 46 is pneumatically monitored by indicator 47 so that the attendant can visually determine when the scrubbing mode has been completed and the charging mode begins. Typically, the scrubbing mode requires approximately 10 minutes, while the charging mode requires 5 additional minutes. After charging has been completed, there is no flow in service line 22, as the pressure at the outlet of low pressure regulator 41 is the same as in sealed cryogenic converter 12.

Figure 7:
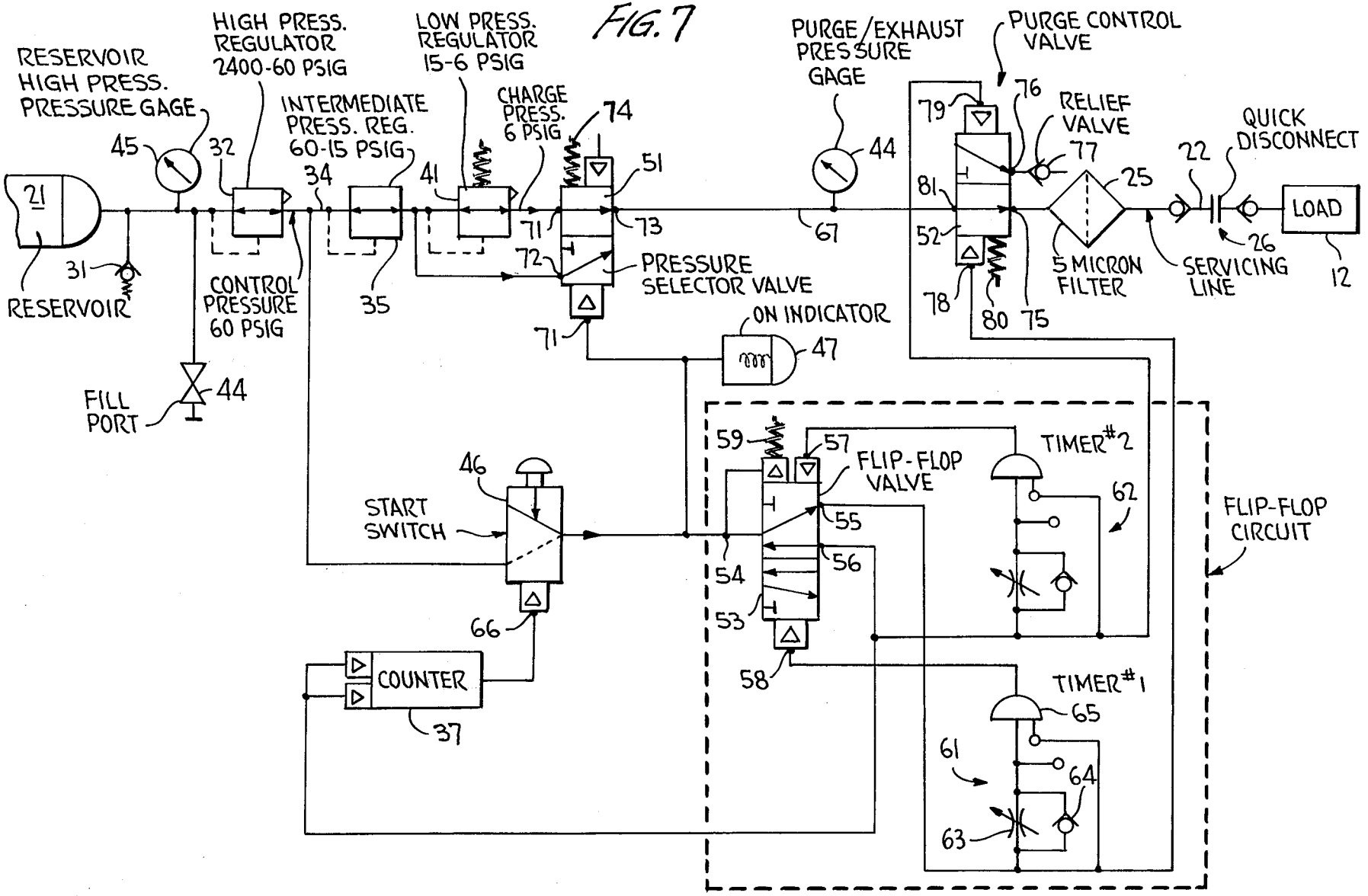
FIG. 7 is a schematic diagram of the apparatus.

Reference is now made to the pneumatic circuit diagram illustrated in FIG. 7, wherein the various components are illustrated in accordance with American National Standard ANS Y 32.10, "Graphic Symbols for Fluid Power Diagrams." Logic circuit 36, in combination with counter 37 and start switch 46, controls the activation of pressure selector valve 51 and purge control valve 52 that are connected in series with each other by line 67, between intermediate pressure regulator 35 and service line 22 while the apparatus is in the scrub mode; while the apparatus is in the charge mode, valves 51 and 52 are connected between low pressure regulator 41 and service line 22.

As previously indicated, logic circuit 36 includes a 4-way spool valve 53 that functions as a bi-stable flow controller between input port 54 and output ports 55 and 56 in response to pneumatic signals respectively applied to control input ports 57 and 58. Valve 53 is initially biased by spring 59 so that flow is from input port 54 to output port 55 when fluid is initially supplied to port 54 through air switch 46.

Fluid flowing from ports 55 and 56 is supplied to pneumatic timers or delay devices 61 and 62 which are connected in feedback circuits to valve 53, by virtue of connections of the outputs of timers 61 and 62 to ports 57 and 58, respectively. Timers 61 and 62 derive relatively short pneumatic pulses 14 and 16 seconds after the leading edges of pressure changes derived from ports 55 and 56, respectively. Timers 61 and 62 are self-extinguishing and are identical to each other except for their time constants; thereby, a description of timer 61 should suffice for both of the timers.

Timer 61 includes a variable restriction 63 shunted by check valve 64 which opens in response to fluid flowing through the restriction. The parallel combination of restriction 63 and check valve 64 is responsive to fluid flow from port 55. Flow from the parallel combination of restriction 63 and exhausting check valve 64 is applied to one input of pneumatic AND gate 65, the other input of which is responsive to flow from port 55. Thereby, AND gate 65 derives a relatively short pneumatic pulse fourteen seconds after the occurrence of a leading edge of a step change in the output pressure of port 55.

The output pulse of timer 61 is applied to control port 58 of flip-flop valve 53, causing the flip-flop valve to change state so that fluid flows from port 54 to port 56. In response to fluid flowing through port 56, timer 62 is energized and derives a relatively short duration output pulse 16 seconds after the leading edge of the flow transition at port 56. The output pulse of timer 62 is coupled back to port 57 of flip-flop valve 53, causing the flip-flop valve to switch back to its initial state, whereby fluid flows from port 54 to port 55.

Sequential operation of flip-flop valve 53, as well as timers 61 and 62, continues in this way until the flip-flop valve has been cycled through a predetermined number, for example 20, of complete cycles. To this end, flow from port 56 is monitored by predetermined counter 37 which is presettable to any factor between one and 40. Counter 37 responds to the leading edge of each flow variation at port 56, to derive an output pulse after the counter has received the preset number of leading edge variations. The output pulse of counter 37 is supplied to control input port 66 of start switch 46, causing the start switch to be activated so that the connection from central manifold 34 to port 54 is closed, thereby terminating further action of the logic network until the start switch is again manually activated.

During the entire interval while fluid is flowing through start switch 46, pressure selector valve 51 is activated so that low pressure regulator 41 is bypassed and the 15 psig output of regulator 35 is applied to line 67 between pressure selective valve 51 and purge control valve 52. Pressure selector valve 51 is a 3-way spool valve having power input ports 71 and 72 that are selectively connected to output port 73, depending upon the position of the valve, as determined by the level of pressure applied to control port 71. Valve 51 is normally biased by a spring 74 so that the low pressure output of regulator 41 is applied from port 71 to port 73 and thence to line 67. In response to start switch 46 being activated so that fluid from regulator 32 flows to port 71, valve 51 is energized so that fluid flows from port 72 to port 73 and line 67. Thereby, during the interval while pneumatic logic circuit 36 is responsive to control pressure from regulator 32, the 15 psig output of regulator 35 is applied to line 67. Upon completion of the scrubbing cycle, when the logic circuit 36 is no longer in operation, the bias of spring 74 activates valve 51 so the low pressure output of regulator 41 is applied from port 71 to port 73 and to line 67.

During the scrubbing mode, complementary flows are supplied by ports 55 and 56 of flip-flop valve 53 to purge control valve 52. During a first interval, while fluid flows from port 55, fluid at a pressure of 15 psig flows from line 67 through valve 52 to service line 22 and converter 12. During a second interval, while fluid flows from port 56, valve 52 is activated so converter 12 is exhausted to 3 psig by fluid flowing from it, through line 22 and valve 52 and check valve 77. To this end, purge control valve 52 is a 3-way spool valve having an inlet port 81 connected to line 67 and a port 75 that is connected to converter 12 via service line 22 during the first interval. Valve 52 includes an additional port 76 that is connected to check valve 77, having a 3 psig bias. During the second interval fluid flows from converter 12 through line 22 and port 75 to port 76. Valve 52 includes control ports 78 and 79 respectively responsive to flows from ports 55 and 56 of flip-flop valve 53. In response to control port 78 being supplied with fluid by port 55, valve 52 is activated so that port 81 supplies fluid to port 75. In response to control port 79 being supplied with fluid by port 56, valve 52 is activated so that ports 75 and 76 are connected with each other to exhaust converter 12 to 3 psig. Spring 80 biases valve 52 so that flow is between ports 81 and 75 when neither of ports 78 nor 79 is responsive to fluid flow.

Figure 8:
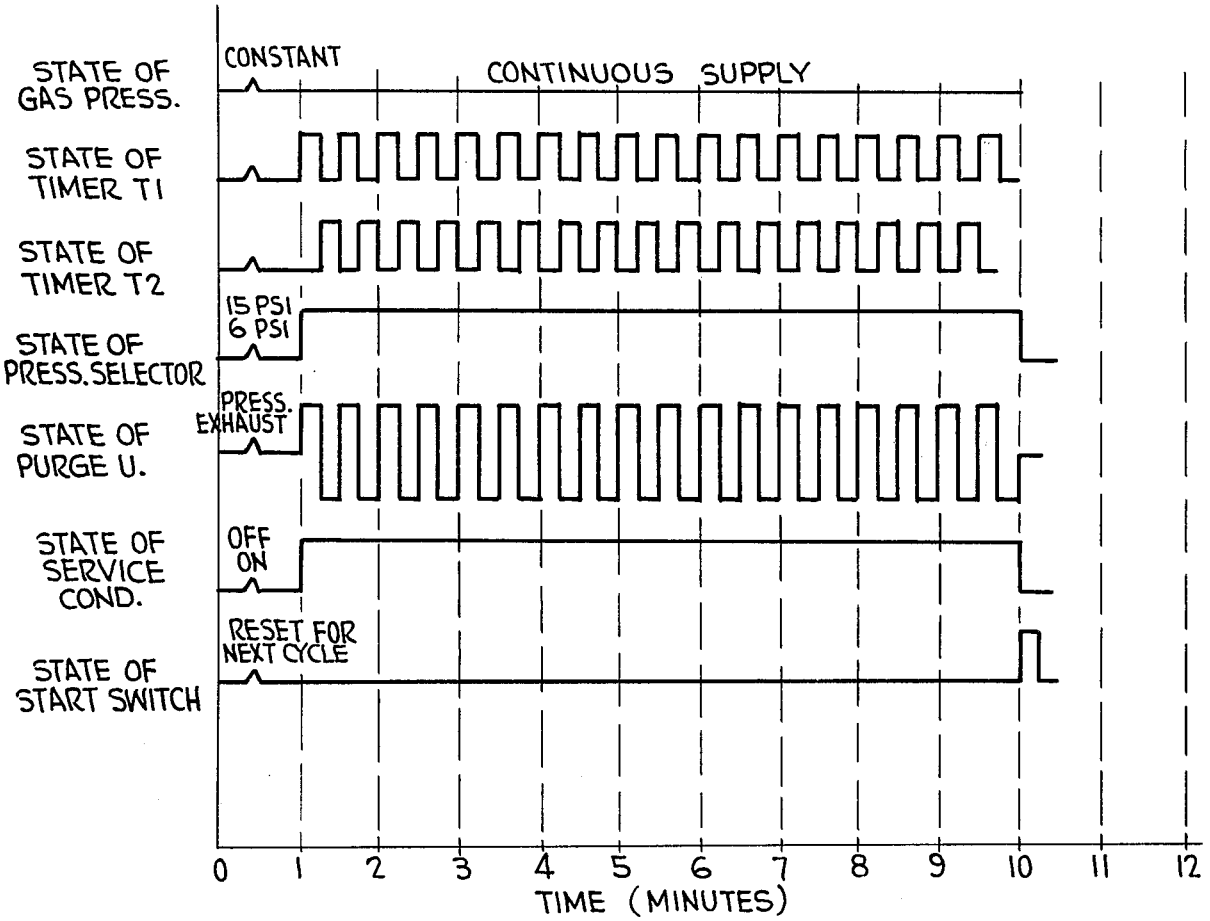
FIG. 8 is a timing diagram of pneumatic signals derived in the system.

To recapitulate the operation, reference is made to FIGS. 7 and 8. Initially, there is no fluid supplied to any of the elements in logic circuit 36, start switch 46 is in a position so that there is no flow through it, and counter 37 is set to zero. Also, regulators 32, 35 and 41 derive pressures of approximately 60 psig, 15 psig and 6 psig; valves 51 and 52 are in the positions illustrated, whereby fluid at approximately 6 psig flows from regulator 41 to service line 22.

In response to start switch 46 being manually activated, control pressure is supplied to port 54 so fluid flows at the 60 psig control pressure from port 55 to timer 61 and port 78 of valve 52. Simultaneously, the outlet of start switch 46 supplies the control pressure to port 71 of valve 51. Thereby, valve 51 is energized so that the 15 psig output pressure of regulator 35 is applied to line 67 and this condition is maintained until there is no flow at the output of switch 46. Also, fluid is supplied at 15 psig from port 81 to port 75 and through line 22 to converter 12. Upon the completion of a 14 second interval, an output pulse is derived by timer 65 and supplied to control port 58 of flip-flop valve 53. The pulse supplied to control port 58 activates valve 53 so that flow from input port 54 is supplied at the 60 psig control pressure to port 56. The control pressure at port 56 energizes counter 37 so that it is advanced by a count of one. Simultaneously, the control pressure is applied from port 56 to control port 79 of purge control valve 52 so that ports 75 and 76 of the purge control valve are connected together, thereby exhausting converter 12 to 3 psig. The leading edge of variation at port 56 is applied to timer 62, which derives an output pulse 16 seconds after the leading edge of the change in the output pressure of port 56, to shift valve 53 back to its initial state.

The cycle continues in this way for ½ minute intervals until counter 37 reaches the predetermined count set in it. Thereby, there is a sequential flow of the inert gas into and out of converter 12 to scrub the converter of contaminants and remove any liquid that has a tendency to remain therein. The operation continues until an output pulse is derived by counter 37, which output pulse is applied to input port 66 of start switch 46 to prevent further flow of fluid to the pneumatic logic network. When fluid stops flowing through start switch 46, valves 51 and 52 are biased to their illustrated position, whereby the approximately 6 psig output of regulator 41 is applied to converter 12 to charge the converter.

While there has been described and illustrated one specific embodiment of the invention, it will be clear that variations in the details of the embodiment specifically illustrated and described may be made without departing from the true spirit and scope of the invention as defined in the appended claims. For example, it is not necessary for all applications to use an inert gas, but an inert gas is preferable for purging and charging a cryogenic converter of the type generally employed on an aircraft for cooling electronic components.

What is claimed is:

1. Apparatus for scrubbing contamination from a sealed container and for charging the scrubbed container with a gas comprising a relatively high pressure source of said gas, pneumatic signal responsive valve means coupled between the source and the container for selectively (a) applying gas from the source to the container and (b) venting the container in response to a pneumatic signal, pneumatic logic means responsive to the source of the gas for sequentially deriving a preselected number of pneumatic signals that control applying of the gas and venting the container, said valve means being constructed so as to sequentially supply and exhaust a flow of gas from the source into and out of the chamber in response to each of said signals to thereby scrub contamination in the container, said logic means further including means for deriving a further pneumatic signal in response to an indication that a scrubbing cycle of the container has been completed, and means responsive to the further pneumatic signal for activating the valve means to apply charging gas at a predetermined pressure from the source to the container.

2. The apparatus of claim 1 wherein the logic means includes a pneumatic bi-stable flow controller having: first and second stable states, input port means responsive to fluid from the source, control port means for selectively activating the flow controller to the first and second states, output port means, and means for controlling the flow from the input port means to the output port means in response to the flow controller being in the first and second states; pneumatic timing means coupled to the output port means for deriving pneumatic control pulses subsequent to changes in state of the flow controller, means for coupling the pneumatic control pulses to the control port means to control the state of the flow controller, and means for coupling the flow from the output port means to the valve means as the pneumatic signal supplied to the valve means.

3. The apparatus of claim 2 further including means responsive to the further pneumatic signal supplied to the valve means for preventing flow from the source to the fluid logic means.

4. The apparatus of claim 3 wherein the flow preventing means includes pneumatic counter means for deriving a flow preventing fluid control signal after a predetermined number of the pneumatic signals are supplied to the valve means.

5. The apparatus of claim 1 further including a variable pressure regulator, said valve means including means for selectively disconnecting and connecting the pressure regulator in circuit with the source and the container while the container is being respectively scrubbed and charged, the variable pressure regulator being arranged to apply different fluid pressures from the source to the container while fluid is flowing into the container during scrubbing and charging.

6. The apparatus of claim 1 wherein the means for deriving the further pneumatic signal includes means responsive to a preselected number of the pneumatic signals.

7. The apparatus of claim 5 wherein the pressure regulator is arranged so that the pressure applied to the chamber during scrubbing is greater than the pressure applied to the chamber during charging.

8. A completely self-contained portable apparatus for scrubbing contamination from a plurality of sealed containers and for charging the scrubbed containers with a gas comprising a housing, handle means on the housing for enabling the housing and the contents thereof to be carried, a reservoir for the gas in the housing, a service line carried by the housing for supplying gas to a container connected to the service line, pneumatic signal responsive valve means in the housing for selectively (a) supplying gas from the reservoir to the line and (b) venting the line in response to a pneumatic signal supplied to the valve means, pneumatic logic means in the housing connected to be responsive to the gas in the reservoir for sequentially deriving a preselected number of pneumatic signals that control supplying of the gas and venting of the line, said valve means being constructed so as to sequentially supply and exhaust a flow of gas from the source into and out of the chamber in response to each of said signals to thereby scrub contamination in the container, said logic means further including means for deriving a further pneumatic signal in response to an indication that a scrubbing cycle of the container has been completed, and means responsive to the further pneumatic signal for activating the valve means to apply charging gas at a predetermined pressure from the reservoir to the line.

9. The apparatus of claim 8 wherein the logic means includes a pneumatic bi-stable flow controller having: first and second stable states, input port means responsive to fluid from the reservoir, control port means for selectively activating the flow controller to the first and second states, output port means, and means for controlling the flow from the input port means to the output port means in response to the flow controller being in the first and second states; pneumatic timing means coupled to the output port means for deriving pneumatic control pulses subsequent to changes in state of the flow controller, means for coupling the pneumatic control pulses to the control port means to control the state of the flow controller, means for coupling the flow from the output port means to the valve means as the pneumatic signal supplied to the valve means.

10. The apparatus of claim 9 further including means responsive to the further pneumatic signal supplied to the valve means for preventing flow from the reservoir to the fluid logic means.

11. The apparatus of claim 10 wherein the flow preventing means includes pneumatic counter means for deriving a flow preventing fluid control signal after a predetermined number of the pneumatic signals are supplied to the valve means.

12. The apparatus of claim 8 further including a variable pressure regulator on the housing, said valve means including means for selectively disconnecting and connecting the pressure regulator in circuit with the reservoir and the line while the container connected to the line is being respectively scrubbed and charged, the variable pressure regulator being arranged to apply different fluid pressures from the reservoir to the line while fluid is flowing into the container during scrubbing and charging.

13. The apparatus of claim 8 wherein the means for deriving the further pneumatic signal includes means responsive to a preselected number of the pneumatic signals.

14. The apparatus of claim 12 wherein the pressure regulator is arranged so that the pressure applied to the line during scrubbing is greater than the pressure applied to the line during charging.

15. Apparatus for scrubbing contamination from a sealed container and for charging the scrubbed container with a gas comprising a relatively high pressure source of said gas, first and second valve means connected between the source and container, pneumatic logic means powered by the source for sequentially deriving a plurality of pneumatic control signals, means responsive to the derivative of a predetermined plurality of the control signals for deactivating the pneumatic logic means, means for coupling the pneumatic control signals to the first valve means, the first valve means being responsive to the pneumatic control signals and connected to the source and container so that gas is supplied from the source to the container through the first valve means and is thereafter vented from the source through the first valve means a plurality of times while the logic means is powered by the source, whereby contamination in the container is scrubbed by the sequential flow of gas into and out of the chamber, a pressure regulator, means responsive to the derivation of the predetermined plurality of control signals for activating the second valve means to connect the pressure regulator between the source and the container so that the container is charged at a pressure determined by the pressure regulator after the container has been scrubbed, the charging pressure differing from the scrubbing pressure.

16. The apparatus of claim 15 wherein the first and second valve means are series connected with each other, and the second valve means includes means for selectively connecting the pressure regulator in series with the first valve means during charging.

17. Apparatus for scrubbing contamination from a sealed container and for charging the scrubbed container with a gas comprising a relatively high pressure source of said gas, valve means connected between the source and container, pneumatic logic means powered by the source for sequentially deriving a plurality of pneumatic control signals, means responsive to the derivation of a predetermined plurality of the control signals for removing power from the pneumatic logic means, means for coupling the pneumatic control signals to the valve means, the valve means being responsive to the pneumatic control signals and connected to the source and container so that gas is supplied from the source to the container through the valve means and is thereafter vented from the source through the valve means a plurality of times while the logic means is powered by the source, whereby contamination in the container is scrubbed by the sequential flow of gas into and out of the chamber, means responsive to the derivation of the predetermined plurality of control signals for activating the valve means to connect the source to the container so that the container is charged at a predetermined pressure after the container has been scrubbed.

18. The apparatus of claim 17 wherein the charging pressure differs from the scrubbing pressure.

* * * * *